US011128975B2

(12) United States Patent
Kobayashi et al.

(10) Patent No.: US 11,128,975 B2
(45) Date of Patent: Sep. 21, 2021

(54) ACOUSTIC SYSTEM AND ACOUSTIC CONTROL DEVICE

(71) Applicant: SOCIONEXT, INC., Kanagawa (JP)

(72) Inventors: Katsumi Kobayashi, Yokohama (JP); Kazutaka Abe, Yokohama (JP); Yoshitaka Mizuno, Yokohama (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 16/904,067

(22) Filed: Jun. 17, 2020

(65) Prior Publication Data

US 2020/0322745 A1 Oct. 8, 2020

Related U.S. Application Data

(63) Continuation of application No. PCT/JP2017/045559, filed on Dec. 19, 2017.

(51) Int. Cl.

| | |
|---|---|
| ***H04S 7/00*** | (2006.01) |
| ***H04R 1/02*** | (2006.01) |
| ***H04R 3/00*** | (2006.01) |

(52) U.S. Cl.

CPC ..... *H04S 7/302* (2013.01); *H04R 1/02* (2013.01); *H04R 3/00* (2013.01); *H04R 2499/13* (2013.01)

(58) Field of Classification Search

CPC .. H04S 7/302; H04R 1/02; H04R 3/00; H04R 2499/13

See application file for complete search history.

(56) References Cited

U.S. PATENT DOCUMENTS

2003/0142835 A1 7/2003 Enya et al.

FOREIGN PATENT DOCUMENTS

| | | | |
|---|---|---|---|
| JP | S61-184143 | A | 8/1986 |
| JP | H07-222277 | A | 8/1995 |
| JP | H10-297382 | A | 11/1998 |
| JP | 2001-008281 | A | 1/2001 |
| JP | 2004-135023 | A | 4/2004 |
| JP | 2006-186646 | A | 7/2006 |
| JP | 3139580 | U | 2/2008 |
| JP | 2010-145906 | A | 7/2010 |
| WO | 2009/072308 | A1 | 6/2009 |

OTHER PUBLICATIONS

Mitamura, Translation of JP2004135023A "Sound outputting appliance, system and method", Apr. 30, 2004 (Year: 2004).*

International Search Report of International Patent Application No. PCT/JP2017/045559 dated Mar. 20, 2018; with English translation.

Written Opinion of the International Searching Authority of International Application No. PCT/JP2017/045559 dated Mar. 20, 2018; with translation of the relevant part.

Notification of the First Office Action issued in corresponding Chinese Patent Application No. 201780097770.4, dated Dec. 29, 2020; with English translation.

* cited by examiner

*Primary Examiner* — Regina N Holder

(74) *Attorney, Agent, or Firm* — McDermott Will and Emery LLP

(57) ABSTRACT

An acoustic system includes an audio output device configured to output a sound to a listener being still at least for a predetermined period of time, and an acoustic control device configured to perform signal processing for localizing, at a specific part of the listener, the sound that is output through the audio output device, wherein the audio output device is installed above the specific part of the listener.

9 Claims, 13 Drawing Sheets

ACOUSTIC SYSTEM AND ACOUSTIC CONTROL DEVICE

CROSS-REFERENCE TO RELATED APPLICATIONS

The present application is a continuation application of international Application PCT/JP2017/045559 filed on Dec. 19, 2017 and designated the U.S., the entire contents of which are incorporated herein by reference.

FIELD

The disclosures herein relate to an acoustic system, an acoustic control device, and a non-transitory computer-readable recording medium having stored therein a control program.

BACKGROUND

As a device for localizing a sound output from an audio output device, such as a speaker, at a specific part of a listener (e.g., an ear), an acoustic control device has been known. The acoustic control device processes an audio signal based on a sound transfer characteristic between an audio output device and a listener. The acoustic control device enables listener to feel as if sounds were output near ears when an audio output device is installed in front of the listener, for example.

RELATED-ART DOCUMENTS

Patent Document

[Patent Document 1] Japanese Laid-Open Patent Publication No. 2001-008281

[Patent Document 2] Japanese Laid-Open Patent Publication No. 61-184143

[Patent Document 3] Japanese Laid-Open Patent Publication No. 10-297382

[Patent Document 4] Japanese Laid-Open Patent Publication No. 2010-145906

[Patent Document 5] Japanese Laid-Open Patent Publication No. 2006-186646

SUMMARY

According to an aspect of the embodiment, an acoustic system includes an audio output device configured to output a sound to a listener being still at least for a predetermined period of time, and an acoustic control device configured to perform signal processing for localizing, at a specific part of the listener, the sound that is output through the audio output device, wherein the audio output device is installed above the specific part of the listener.

DESCRIPTION OF EMBODIMENTS

Figure 1:
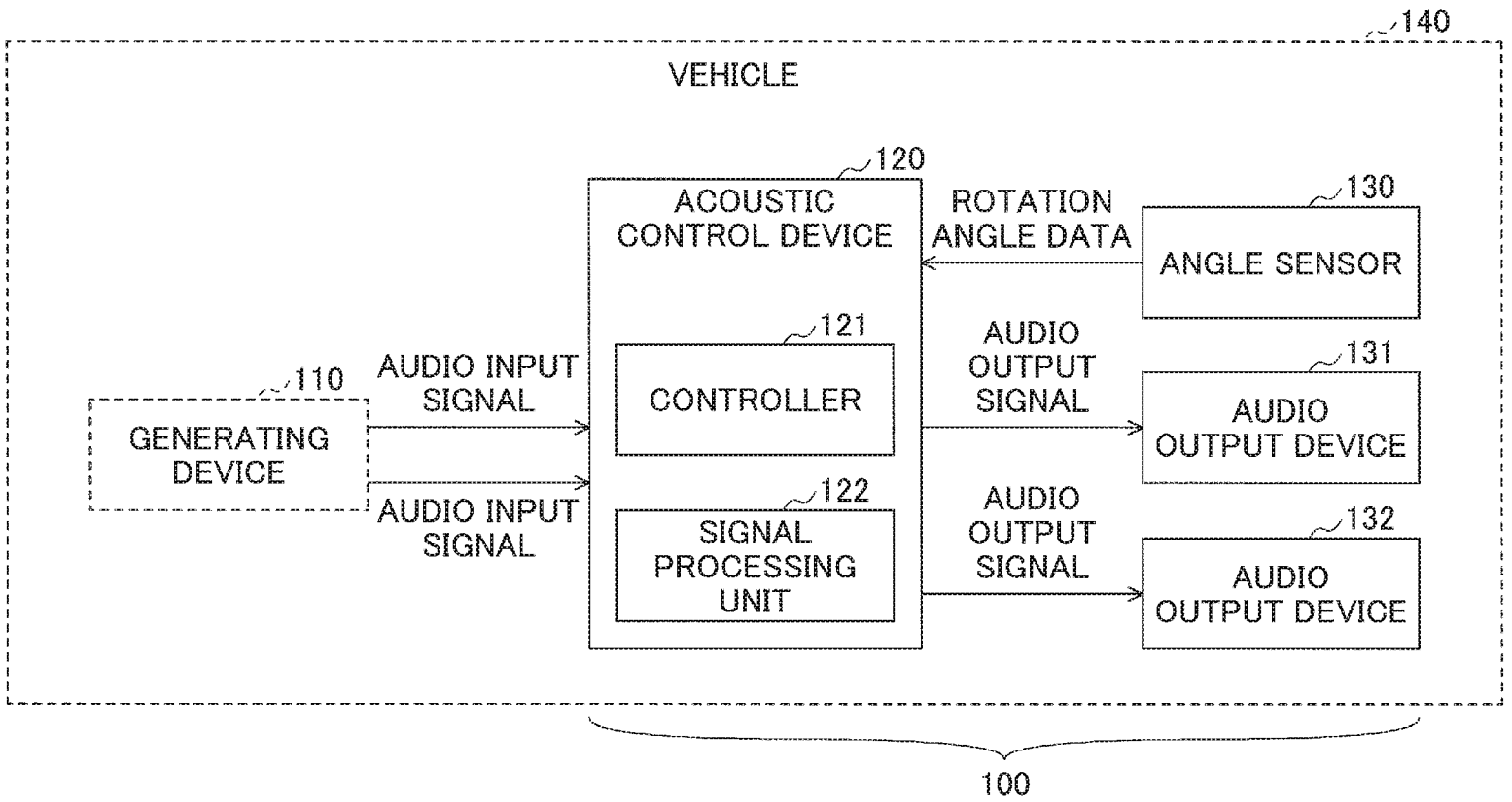
FIG. 1 is a drawing illustrating an example of a system configuration of an acoustic system according to a first embodiment.

In a state in which an obstacle interfering with a sound is likely to exist between an audio output device and a listener, or in a state in which an installation position of an audio output device is easily changed, a sound transfer characteristic between the audio output device and the listener changes, and it is difficult to continuously localize the sound.

In the following, each embodiment will be described with reference to the accompanying drawings. In the present specification and the drawings, the components having substantially the same functional configuration are referred by the same reference numerals, and overlapping description is omitted.

First Embodiment

System Configuration of an Acoustic System

First, a system configuration of an acoustic system will be described. FIG. 1 is a drawing illustrating an example of the system configuration of an acoustic system according to a first embodiment. In the embodiment, an acoustic system 100 is mounted to a vehicle 140.

As illustrated in FIG. 1, the acoustic system 100 includes an acoustic control device 120, an angle sensor 130, and audio output devices 131 and 132.

The acoustic control device 120 is connected to a generating device 110 and receives audio input signals generated in the generating device 110. In the present embodiment, the generating device 110 is, for example, an in-vehicle device that generates the audio input signals, such as a navigation device having a voice guidance function.

A control program and a signal processing program are installed in the acoustic control device 120, and the acoustic control device 120 functions as a controller 121 and a signal processing unit 122 by the program being executed.

The controller 121 is an example of an obtaining means and obtains rotation angle data transmitted from the angle sensor 130. The controller 121 is also an example of a storage means and stores a parameter used by the signal processing unit 122 for performing signal processing on the audio input signals. The controller 121 determines a parameter that is used by the signal processing unit 122 for performing the signal processing on the audio input signals in accordance with the obtained rotation angle data, among the stored parameters.

The signal processing unit 122 is an example of a signal processing means. The signal processing unit 122 performs the signal processing on the audio input signals using the parameter determined in the controller 121 and outputs audio output signals to the audio output devices 131 and 132.

The angle sensor 130 measures the rotation angle of a predetermined member on which the audio output devices 131 and 132 are installed inside the vehicle 140 and transmits the measured result as the rotation angle data to the acoustic control device 120. In the present embodiment, the audio output devices 131 and 132 are installed at an end of a sun visor mounted to the vehicle 140. Thus, in the embodiment, the angle sensor 130 measures the rotation angle of the sun visor.

The audio output devices 131 and 132 are what is called speakers that, output sounds based on audio output signals transmitted from the acoustic control device 120.

Hardware Configuration of the Acoustic Controller

Figure 2:
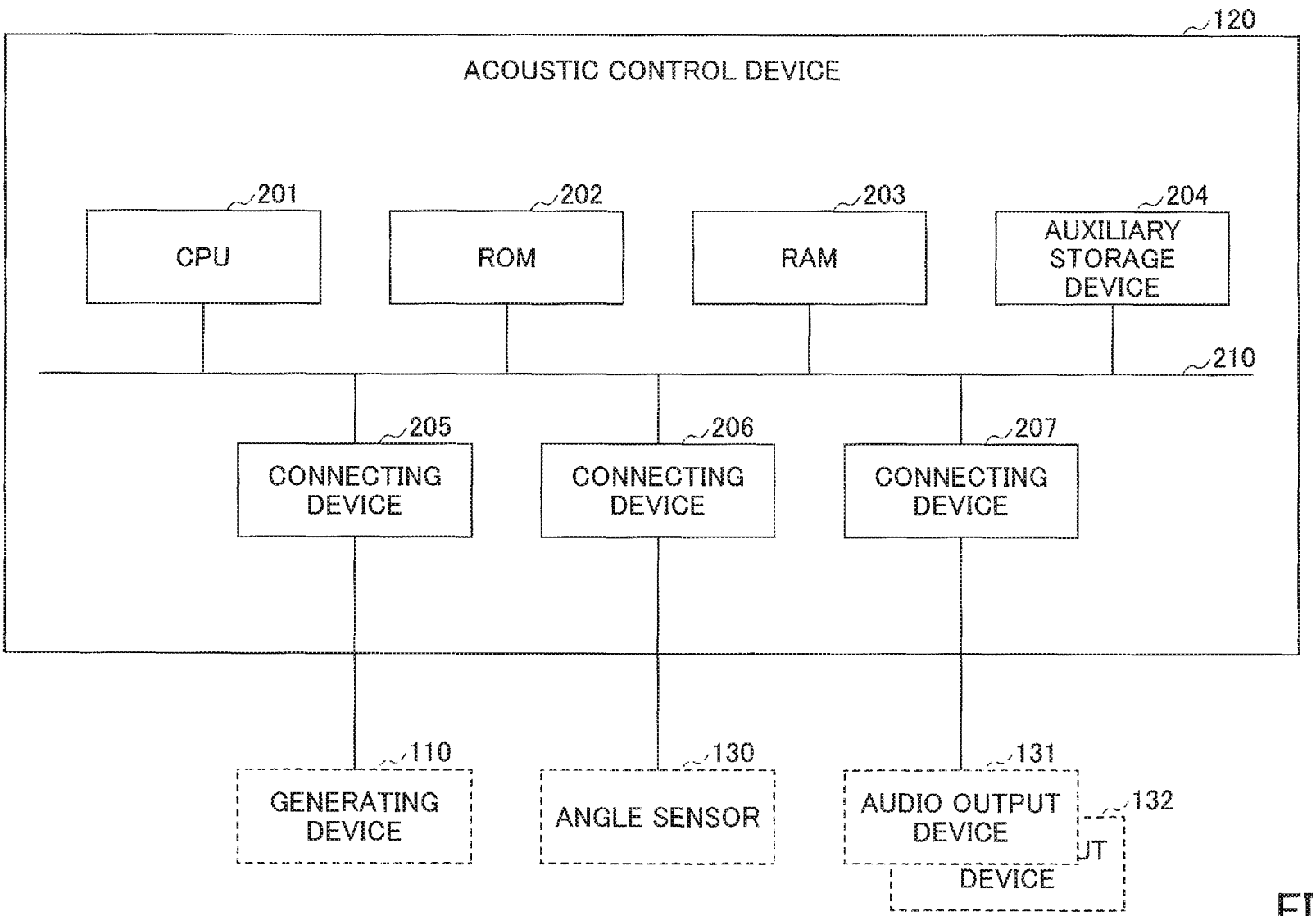
FIG. 2 is a drawing illustrating an example of a hardware configuration of the acoustic system.

Next, a hardware configuration of the acoustic control device 120 will be described. FIG. 2 is a drawing illustrating an example of the hardware configuration of the acoustic system.

As illustrated in FIG. 2, the acoustic control device 120 includes a central processing unit (CPU) 201, a read only memory (ROM) 202, and a random access memory (RAM) 203. The CPU 201, the ROM 202, and the RAM 203 form what is called a computer.

The acoustic control device 120 also includes an auxiliary storage device 204 and connecting devices 205 to 207. Each hardware of the acoustic control device 120 is interconnected through a bus 210.

The CPU 201 is an arithmetic device that executes various programs (for example, the control program, the signal processing program, and so on) installed in the auxiliary storage device 204.

The ROM 202 is a non-volatile memory. The ROM 202 functions as a main storage device for storing various programs and data required for the CPU 201 executing various programs installed in the auxiliary storage device 204. Specifically, the ROM 202 stores, for example, a boot program, such as Basic Input/Output System (BIOS) and Extensible Firmware interface (EFI).

The RAM 203 is a volatile memory, such as a dynamic random access memory (DRAM) or a static random access memory (SRAM). The RAM 203 functions as a main storage device that provides a work area developed when various programs installed in the auxiliary storage device 204 are executed by the CPU 201.

The auxiliary storage device 204 is an auxiliary storage device that stores various programs and parameters used for executing various programs.

The connecting device 205 is a connecting device that connects to the generating device 110 and receives the audio input signal transmitted from the generating device 110. The connecting device 206 is a connecting device that connects to the angle sensor 130 and receives the rotation angle data transmitted from the angle sensor 130. The connecting device 207 is a connecting device that connects to the audio output devices 131 and 132 and transmits the audio output signals generated by the signal processing program executed by the CPU 201, to the audio output devices 131 and 132.

Overview of Signal Processing

Figure 3:
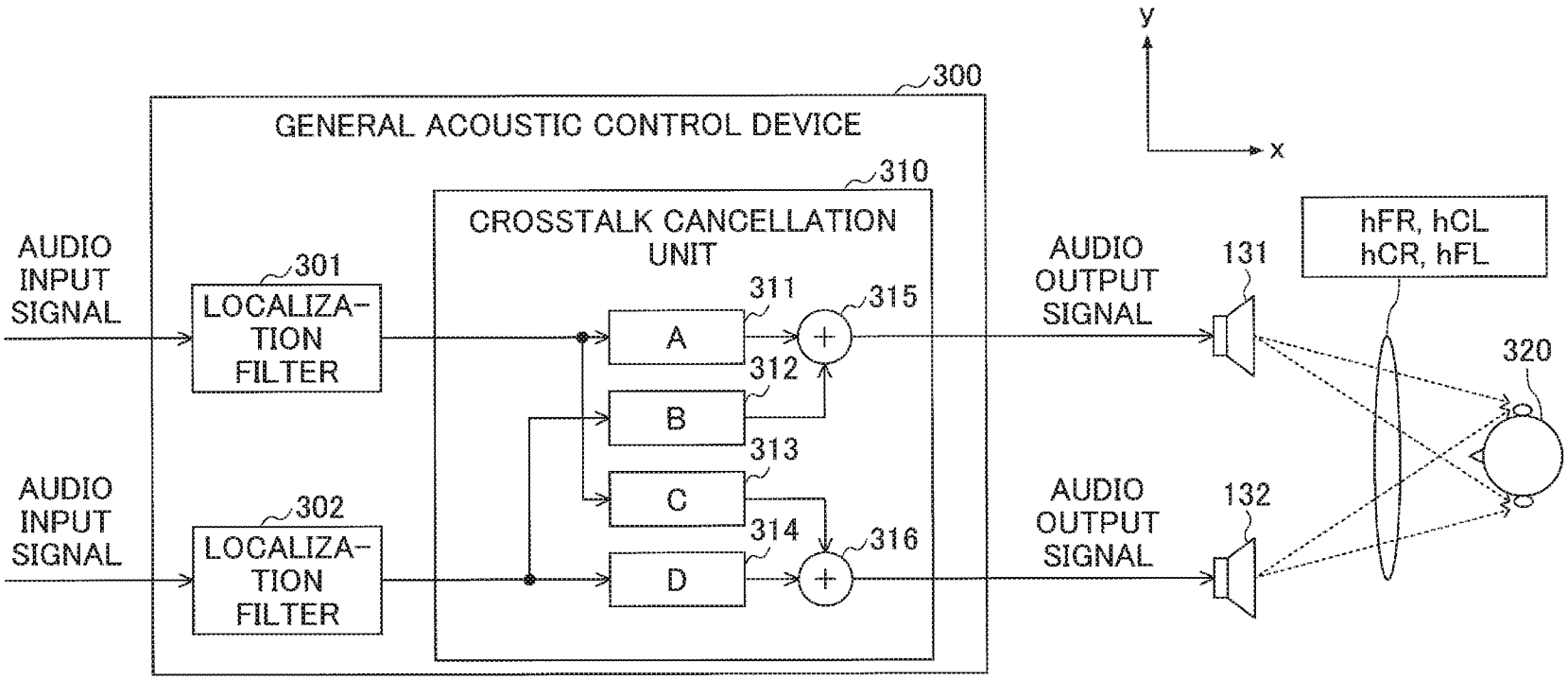
FIG. 3 is a drawing for describing an overview of general signal processing for localizing a sound at a specific part of a listener.

Next, an overview of general signal processing for localizing the sound at a specific part of the listener will be described. FIG. 3 is a drawing for describing the overview of the general signal processing for localizing a sound at the specific part of the listener.

As illustrated in FIG. 3, a general acoustic control device 300 includes localization filters 301 and 302 and a crosstalk cancellation unit 310.

The localization filter 301 is a filter designed so that the sound of the audio input signal is heard from the right direction of the listener 320 (i.e., a driver of the vehicle 140 in the embodiment). The audio input signal filtered in the localization filter 301 is input to the crosstalk cancellation unit 310.

The localization filter 302 is a filter designed so that the sound of the audio input signal is heard from the left direction of the listener 320. The audio input signal filtered in the localization filter 302 is input to the crosstalk cancellation unit 310.

The crosstalk cancellation unit 310 multiplies transfer functions A to D with respect to the filtered audio input signals that are input from the localization filters 301 and 302. Here, the transfer functions A to D are calculated based on the following equation.

$$\begin{bmatrix} A & B \\ C & D \end{bmatrix} = \begin{bmatrix} hFR, & hCL \\ hCR, & hFL \end{bmatrix}^{-1} \quad \text{[Eq. 1]}$$

In the equation above, "hFR" is a measured value indicating the sound transfer characteristic from the audio output device 131 to the right ear of the listener 320, and "hFL" is a measured value of the sound transfer characteristic from the audio output device 132 to the left ear of the listener 320. "hCR" is a measured value indicating the sound transfer characteristic from the audio output device 131 to the left ear of the listener 320, and "hCL" is a measured value indicating the sound transfer characteristic from the audio output device 132 to the right ear of the listener 320.

A multiplier 311 multiplies the filtered audio input signal that is input from the localization filter 301 by the transfer function A. A multiplier 312 multiplies the filtered audio input signal that is input from the localization filter 302 by the transfer function B.

A multiplier 313 multiplies the filtered audio input signal that is input from the localization filter 301 by the transfer function C. A multiplier 314 multiplies the filtered audio input signal that is input from the localization filter 302 by the transfer function D.

An adder 315 adds the audio input signals multiplied by the transfer functions A and B in the multiplier 311 and the multiplier 312 respectively, and transmits a result as the audio output signal to the audio output device 131. An adder 316 adds the audio input signals multiplied by the transfer functions C and D in the multiplier 313 and the multiplier 314 respectively, and transmits a result as the audio output signal to the audio output device 132.

This enables the general acoustic control device 300 to localize the sound of the audio input signal transmitted from the generating device 110 at the right ear and the left ear of the listener 320.

As illustrated in FIG. 3, in the embodiment, a direction from the front to the rear of the listener 320 in a state in which the listener 320 is seated in a driver's seat and is still for a certain period of time (i.e., a direction from the front to the rear of the vehicle 140) is the x-axis direction. Additionally, a direction from the left ear to the right ear of the listener 320 (i.e., a width direction of the vehicle 140 from the left to the right) is the y-axis direction.

Installation Example of the Acoustic System

Figure 4:
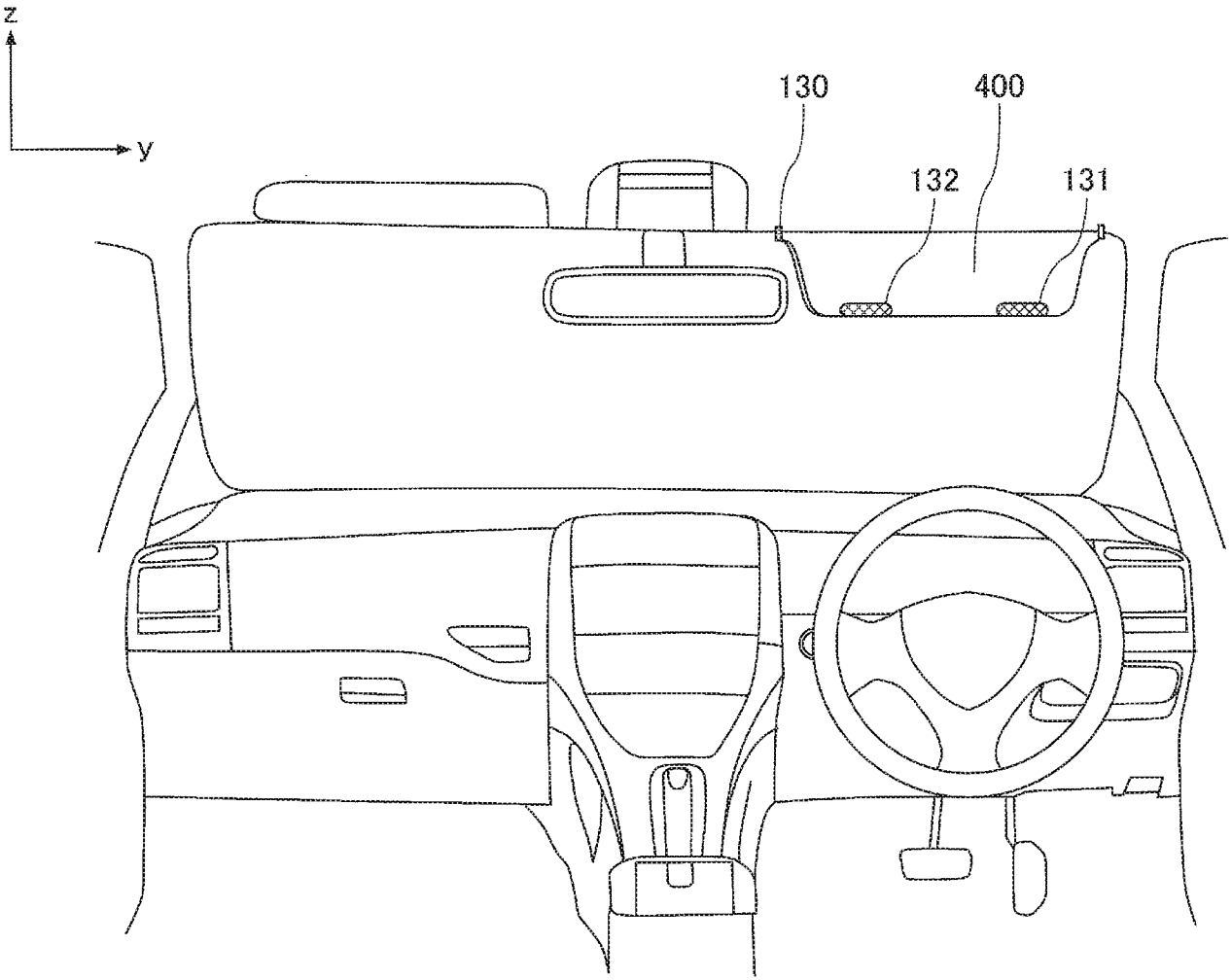
FIG. 4 is a drawing illustrating an installation example of each device constituting the acoustic system according to the first embodiment inside a vehicle.

Next, an installation example of each device constituting the acoustic system 100 inside the vehicle 140 will be described. FIG. 4 is a drawing illustrating an installation example of each device constituting the acoustic system according to the first embodiment inside the vehicle. The example of FIG. 4 illustrates a state in which a sun visor 400 mounted on the driver seat side of the vehicle 140, is lowered.

As illustrated in FIG. 4, the audio output devices 131 and 132 are installed along the y-axis direction at an end of the sun visor 400. Specifically, when viewed from the driver's seat side, the audio output device 131 is installed on the right side and the audio output device 132 is installed on the left side.

As described above, in the acoustic system 100 according to the first embodiment, the audio output devices 131 and 132 are installed above parts where the audio output signals are localized for the listener 320 seated in the driver's seat (i.e., the ears of the receiver 320).

Thus, the acoustic system 100 can prevent the sound transfer characteristic between the audio output device 131 with the audio output device 132 and the listener from being changed by an obstacle interfering with the sound between the audio output device 131 with the audio output device 132 and the listener 320. As a result, the acoustic system 100 can continuously localize the sounds output from the audio output devices 131 and 132 at the ears of the listener 320.

As illustrated in FIG. 4, the angle sensor 130 is installed on a rotating portion of the sun visor 400 to measure the rotation angle of the sun visor 400. This enables the angle sensor 130 to measure the rotation angle of the sun visor 400. As a result, in the acoustic control device 120, even when the rotation angle of the sun visor 400 (i.e., installation positions of the audio output devices 131 and 132) is changed, the changed rotation angle can be measured to perform the signal processing in accordance with the changed rotation angle. That is, the acoustic system 100 can continuously localize the sounds output from the audio output devices 131 and 132 at the ears of the listener 320.

Changing the Installation Positions of the Audio Output Devices

Figure 5A:
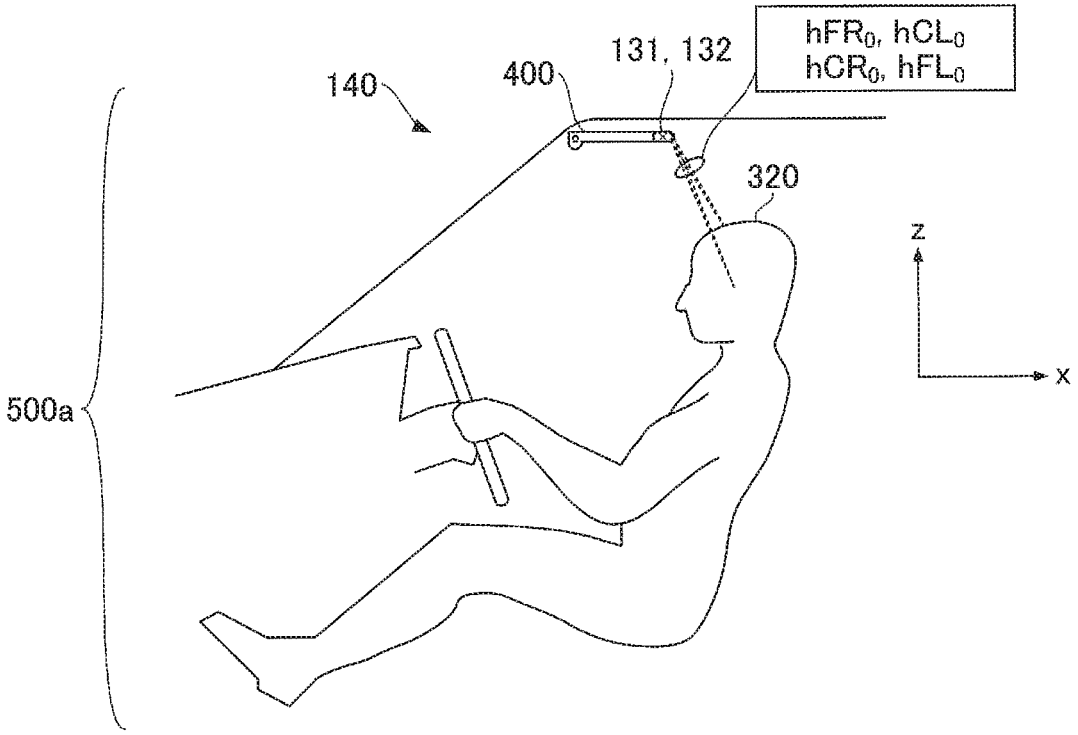
FIGS. 5A and 5B are drawings each illustrating a state in which installation positions of audio output devices are changed.
Figure 5B:
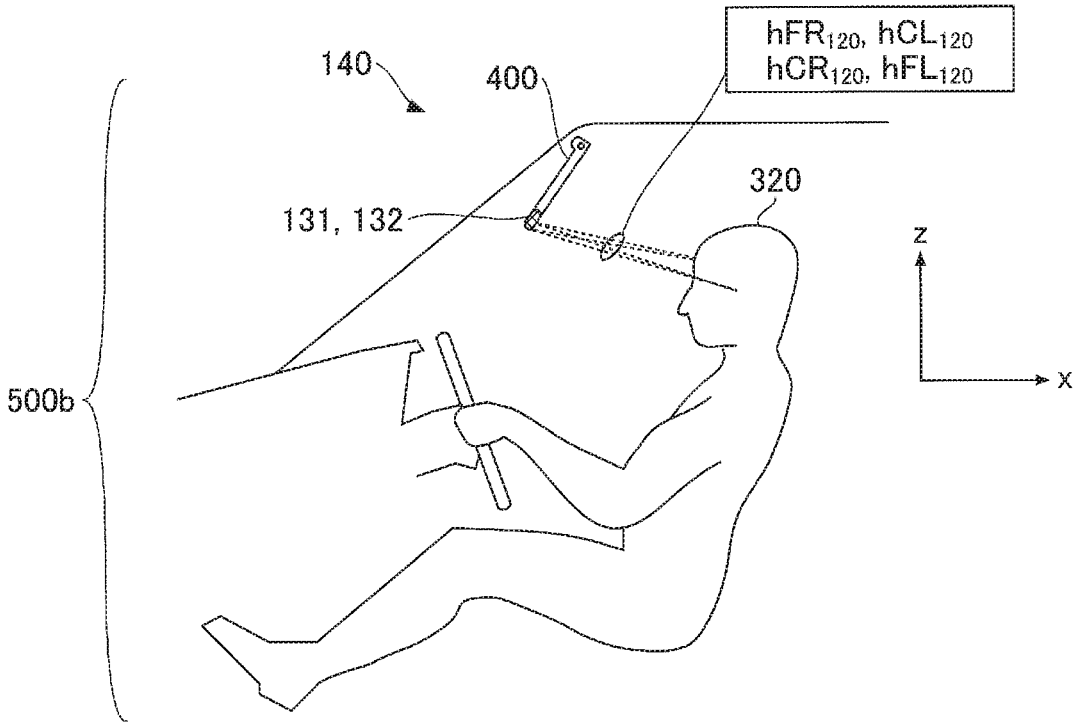

Next, a change of the transfer functions when the installation positions of the audio output devices 131 and 132 installed on the sun visor 400 are changed while the listener 320 is seated in the driver's seat and is still for a certain period of time, will be described. FIG. 5A and FIG. 5B are drawings each illustrating a state in which the installation positions of the audio output devices are changed.

Among these, a state 500*a* indicates a state in which the listener 320 is seated in the driver's seat of the vehicle 140 and is still for a certain period of time before the sun visor 400 is lowered. In the embodiment, the rotation angle of the sun visor 400 illustrated in the state 500*a* is considered to be "0 degrees".

In the state 500*a*, a measured value indicating the sound transfer characteristic from the audio output device 131 to the right ear of the listener 320 is "$hFR_0$". A measured value indicating the sound transfer characteristic from the audio output device 132 to the left ear of the listener 320 is "$hFL_0$".

Additionally, a measured value indicating the sound transfer characteristic from the audio output device 131 to the left ear of the listener 320 is "$hCR_0$". Further, a measured value indicating the sound transfer characteristic from the audio output device 132 to the right ear of the listener 320 is "$hCL_0$".

A state 500*b* indicates a state in which the listener 320 is seated in the driver's seat of the vehicle 140 and is still for a period of time after the sun visor 400 has been lowered. In the embodiment, the rotation angle of the sun visor 400 illustrated in the state 500*b* is "120 degrees".

In the state 500*b*, a measured value indicating the sound transfer characteristic from the audio output device 131 to the right ear of the listener 320 is "$hFR_{120}$". A measured value indicating the sound transfer characteristic from the audio output device 132 to the left ear of the listener 320 is "$hFL_{120}$".

Additionally, a measured value indicating the sound transfer characteristic from the audio output device 131 to the left ear of the listener 320 is "$hCR_{120}$". Further, a measured value indicating the sound transfer characteristic from the audio output device 132 to the right ear of the listener 320 is "$hCL_{120}$".

When the audio output devices 131 and 132 are installed on the sun visor 400, measured values indicating the sound transfer characteristics are changed in accordance with the rotation angle of the sun visor 400. Thus, in the acoustic control device 120 according to the present embodiment, the sound transfer characteristics are measured for each rotation angle of the sun visor 400, and the transfer functions A to D are switched in accordance with the rotation angle of the sun visor 400. This can continuously localize the sounds output from the audio output devices 131 and 132 at the ears of the listener 320 even when the installation positions of the audio output devices 131 and 132 are changed by the listener 320 moving the sun visor 400.

Functional Configuration of the Acoustic Control Device

Figure 6:
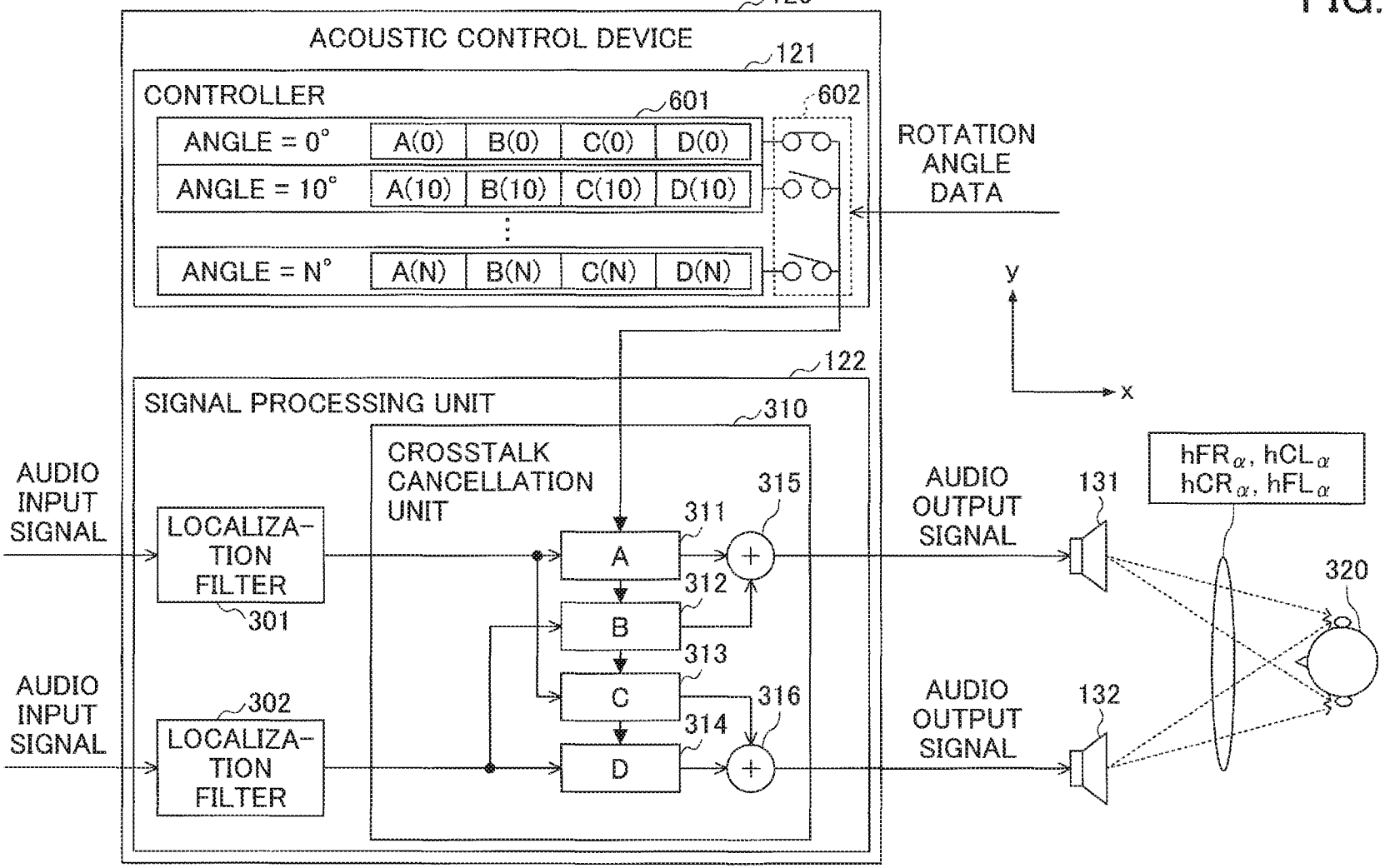
FIG. 6 is a drawing illustrating a functional configuration of the acoustic system according to the first embodiment.

Next, a functional configuration of the acoustic control device 120 according to the first embodiment will be described. FIG. 6 is a drawing illustrating a functional configuration of the acoustic system according to the first embodiment.

As illustrated in FIG. 6, the controller 121 includes a parameter storage unit 601 and a switching unit 602. The parameter storage unit 601 stores the transfer functions A to D for each rotation angle of the sun visor 400. The switching unit 602 switches transfer functions to be used in accordance with the rotation angle data transmitted from the angle sensor 130. The example of FIG. 6 illustrates a state in which the transfer functions are switched to A(0), B(0), C(0), and D(0), since the rotation angle of the sun visor 400 is "0 degrees". The switching unit 602 sets the transfer functions A to D used by the signal processing unit 122 to the multipliers 311 to 314, respectively.

The signal processing unit 122 includes the localization filters 301 and 302 and the crosstalk cancellation unit 310. Here, the localization filters 301 and 302 and the crosstalk cancellation unit 310 included in the signal processing unit 122 of FIG. 6, have the same basic configurations as the localization filters 301 and 302 and the crosstalk cancellation unit 310 included in the general acoustic control device 300 of FIG. 3. Thus, the detailed description is omitted here. Here, in the crosstalk cancellation unit 310 included in the general acoustic control device 300 of FIG. 3, fixed values are set to the multipliers 311 to 314. However, in the crosstalk cancellation unit 310 included in the signal processing unit 122 of FIG. 6, variable values are set. Specifically, the transfer functions A to D transmitted from the controller 121 are set to the multipliers 311 to 314.

Flow Chart of an Acoustic Control Process

Figure 7:
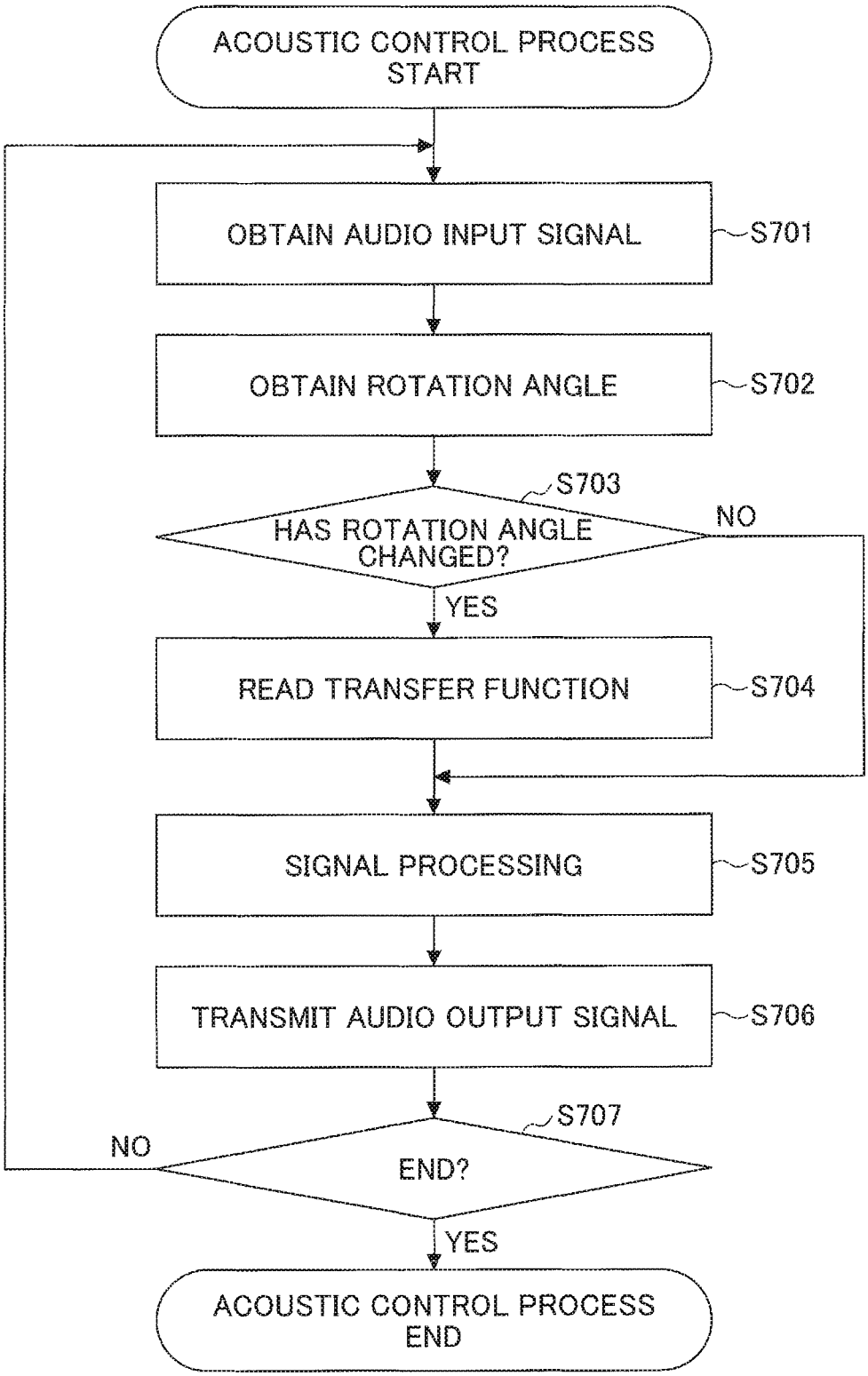
FIG. 7 is a flowchart illustrating a flow of an acoustic control process performed by the acoustic control device.

Next, a flow of an acoustic control process performed by the acoustic control device 120 will be described. FIG. 7 is a flowchart illustrating the flow of the acoustic control process performed by the acoustic control device. In response to the power-on of the acoustic system 100, an execution of the flowchart illustrated in FIG. 7 is started, and in response to the power-off of the acoustic system, the execution of the flowchart illustrated in FIG. 7 is completed.

In step S701, when the audio input signals are transmitted from the generating device 110, the localization filters 301 and 302 obtain the audio input signals, respectively.

In step S702, the controller 121 obtains the rotation angle data transmitted from the angle sensor 130 and determines the current rotation angle of the sun visor 400.

In step S703, the switching unit 602 of the controller 121 determines whether the rotation angle data transmitted from the angle sensor 130 has changed (i.e., whether the installation positions of the audio output devices 131 and 132 have been changed).

In step S703, when it is determined that the rotation angle data has changed (YES in step S703), the switching unit 602 switches a connection destination and reads transfer functions corresponding to the determined rotation angle based on the rotation angle data. The switching unit 602 sets the read transfer functions to the signal processing unit 122, and proceeds to step S705. This enables the switching unit 602 to set new transfer functions to the multipliers 311 to 314 of the signal processing unit 122 in accordance with a change of the installation positions of the audio output devices 131 and 132.

In step S703, when it is determined that the rotation angle data has not changed (NO in step S703), the switching unit 602 proceeds to step S705 without switching the connection destination. In this case, the signal processing unit 122 performs the signal processing using the transfer functions previously set for respective multipliers 311 to 314.

In step S705, the signal processing unit 122 performs the signal processing on the audio input signals using the transfer functions that are set to respective multipliers 311 to 314.

In step S706, the signal processing unit 122 transmits the audio input signals on which the signal processing is performed as the audio output signals to the audio output devices 131 and 132.

In step S707, the signal processing unit 122 determines whether to end the signal processing for the audio input signals, and when it is determined not to end the signal processing (NO in step S707), the process returns to step S701. In step 707, when it is determined to end the process (YES in step S707), the sound control process ends.

Summary

As is clear from the description above, in the acoustic system 100 according to the first embodiment, the audio output devices are installed on the sun visor mounted above the ears of the listener when the sounds are localized at the ears of the listener seated in the driver's seat of the vehicle.

Thus, the acoustic system 100 according to the first embodiment can prevent the sound transfer characteristic between the audio output devices and the listener from being changed by an obstacle interfering with the sound between the audio output devices and the listener.

Additionally, the acoustic control device 120 according to the first embodiment performs the following processes:

The angle sensor for measuring the rotation angle of the sun visor is further installed on the sun visor, on which audio output devices are installed, to measure the rotation angle of the sun visor (the rotation angle may be measured in real time or periodically).

For each rotation angle, the sound transfer characteristics are measured and the transfer functions calculated based on the measured values are stored in advance.

Signal processing is performed on the audio input signals using the transfer functions corresponding to the measured rotation angle.

Thus, even when the installation positions of the audio output devices are changed by the receiver moving the sun visor, the acoustic control device 120 can switch transfer functions in accordance with the installation positions to perform the signal processing.

As a result, the present embodiment can continuously localize the sounds output from the audio output devices at the ears of the receiver.

Second Embodiment

The above description of the first embodiment assumes that two audio output devices 131 and 132 are installed at the end of the sun visor 400. However, the number of installed audio output devices is not limited to two. Also, the installation position of the audio output device is not limited to the end of the sun visor 400. In the following, a second embodiment will be described focusing on differences from the first embodiment described above.

System Configuration of the Acoustic System

Figure 8:
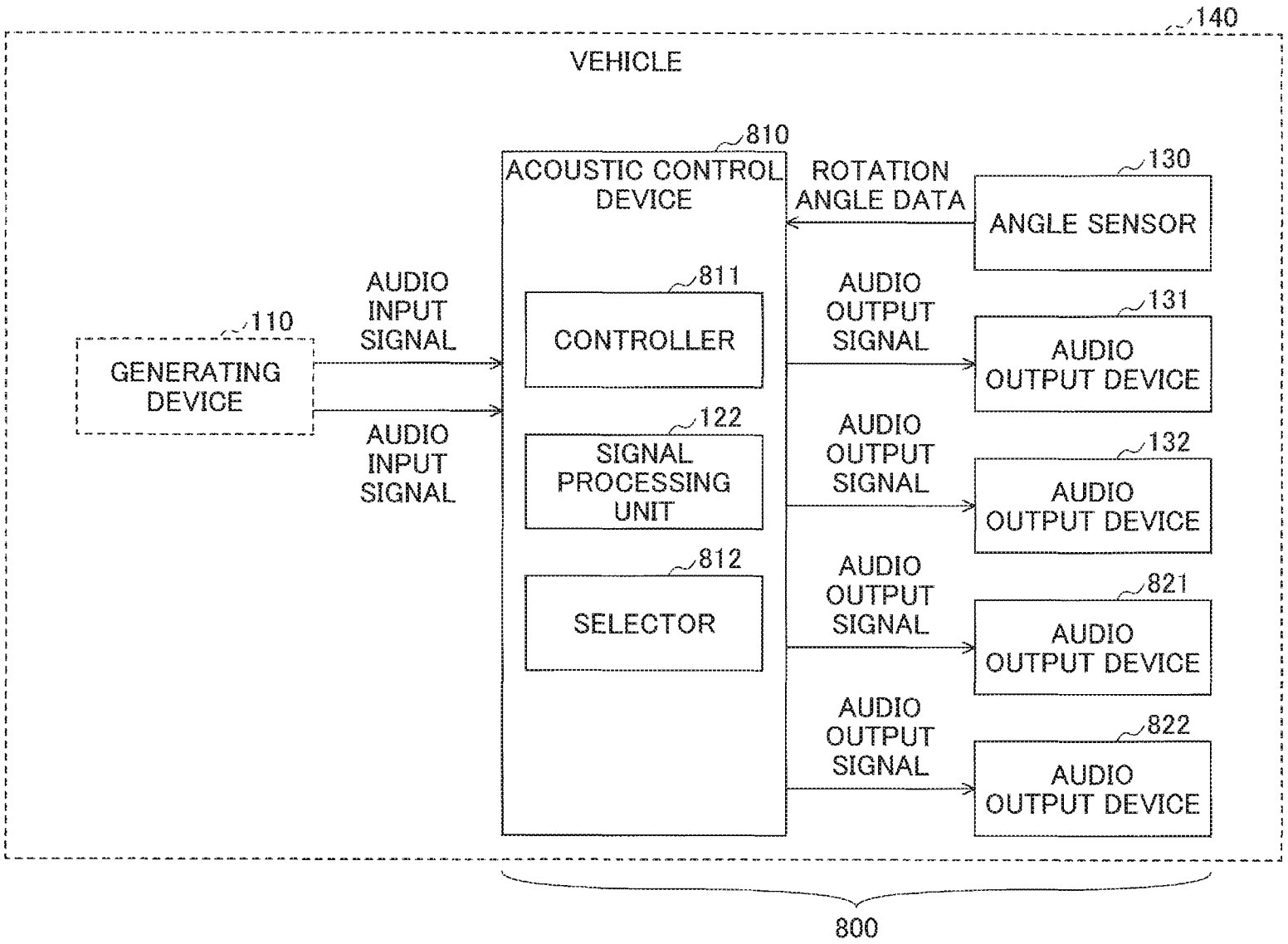
FIG. 8 is a drawing illustrating an example of a system configuration of an acoustic system according to a second embodiment.

First, a system configuration of the acoustic system according to the second embodiment will be described. FIG. 8 is a drawing illustrating an example of the system configuration of the acoustic system according to the second embodiment.

The acoustic system 800 according to the second embodiment illustrated in FIG. 8 is different from the acoustic system 100 according to the first embodiment illustrated in FIG. 1 in that in the acoustic system 800, an acoustic control device 810 includes a controller 811 and a selector 812. In the acoustic system 800, in addition to the audio output devices 131 and 132, the audio output devices 821 and 822 are also included (i.e., in the acoustic system 800, there are multiple sets of audio output devices (four in total)).

Installation Example or the Acoustic System

Figure 9:
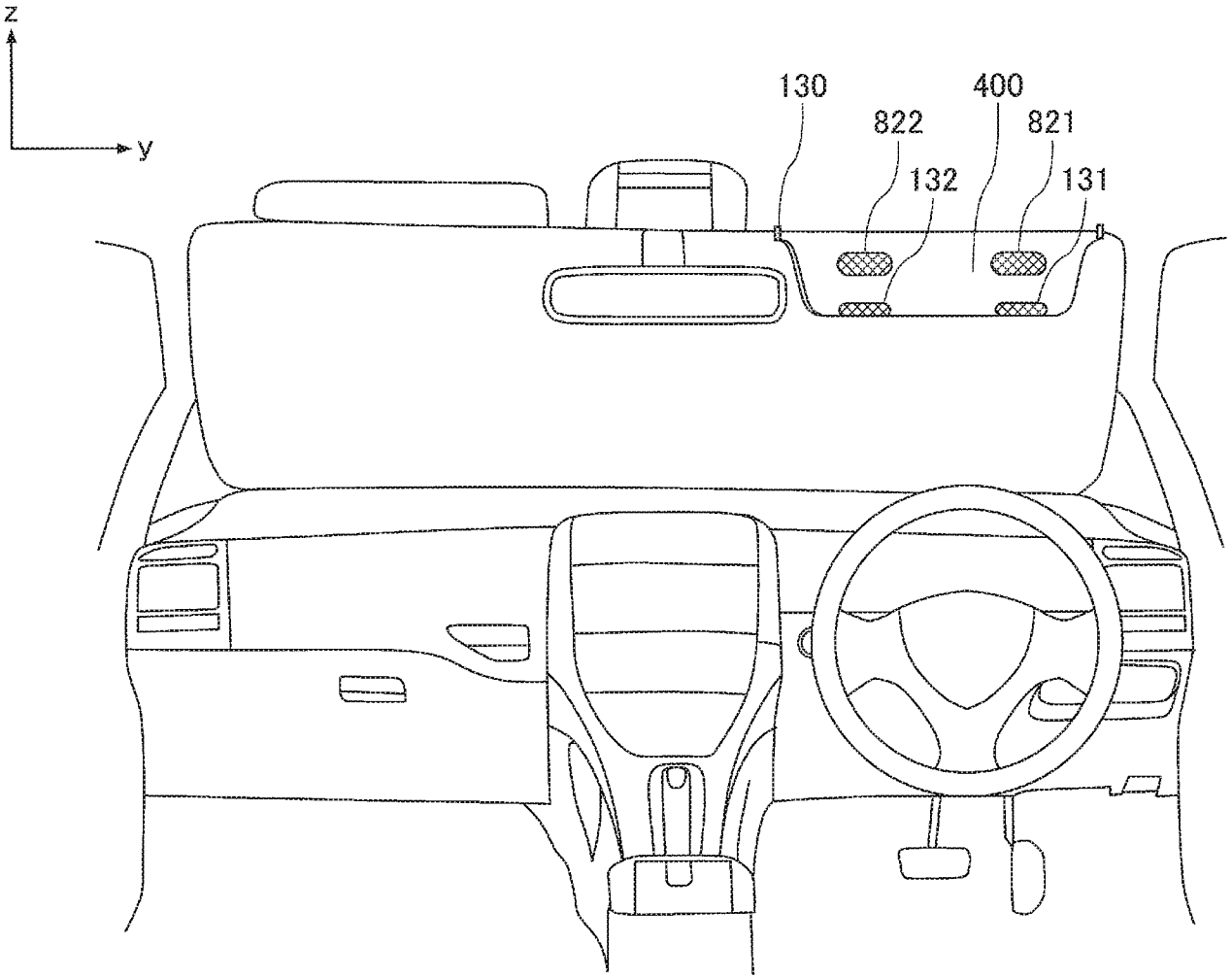
FIG. 9 is a drawing illustrating an installation example of each device constituting the acoustic system according to the second embodiment inside a vehicle.

Next, an installation example of each device constituting the acoustic system 800 inside the vehicle 140 will be described. FIG. 9 is a drawing illustrating the installation example of each device constituting the acoustic system according to the second embodiment inside the vehicle. As illustrated in FIG. 9, the audio output devices 131 and 132 are installed along the y-axis direction at the end of the sun visor 400, and the audio output devices 821 and 822 are installed along the y-axis direction at the central portion of one surface of the sun visor 400.

As described, in the acoustic system 800 according to the second embodiment, the audio output devices 821 and 822 are installed to face the listener 320 seated in the driver's seat with the sun visor 400 being lowered. This enables the acoustic system 800 to continuously localize the sounds at the ears of the listener 320 in a more stable state by outputting the sounds through the audio output devices 821 and 822 with the sun visor 400 being lowered.

Change of the Installation Positions of the Audio Output Devices

Figure 10A:
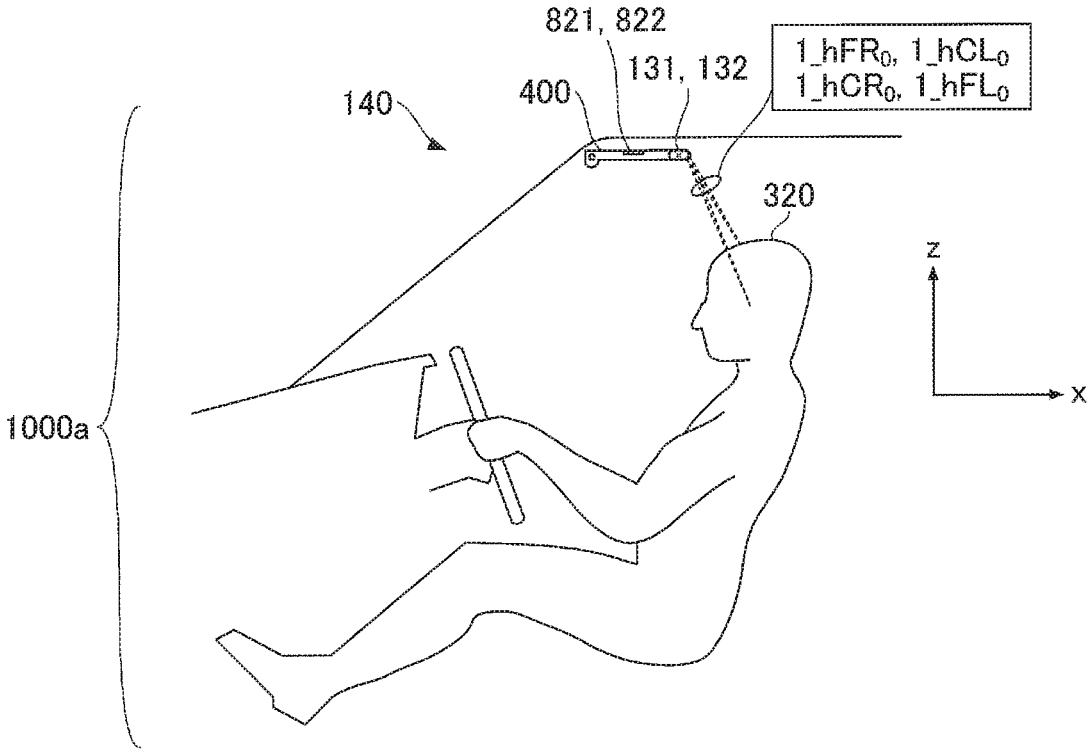
FIG. 10A and FIG. 10B are drawings each illustrating a state in which installation positions of audio output devices are changed.
Figure 10B:
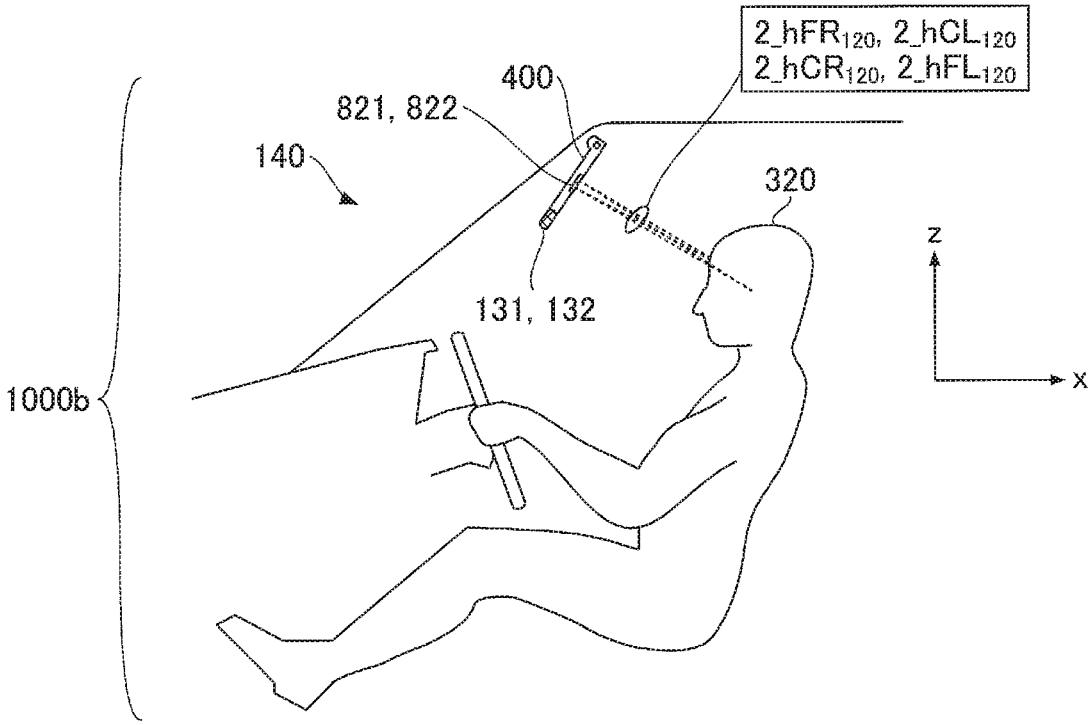

Next, a change of the transfer functions when the installation positions of the audio output devices 131, 132, 821, and 822 installed on the sun visor 400 are changed while the listener 320 is seated in the driver's seat and is still for a certain period of time, will be described. FIG. 10A and FIG. 10B are drawings each illustrating a state in which the installation positions of audio output devices are changed.

Among these, a state 1000*a* indicates a state in which the listener 320 is seated in the driver's seat of the vehicle 140 and is still for a certain period of time before the sun visor 400 is lowered. In the state 1000*a*, the acoustic control device 120 according to the second embodiment outputs the sounds through the audio output devices 131 and 132.

Here, in the state 1000*a*, a measured value indicating the sound transfer characteristic from the audio output device 131 to the right ear of the listener 320 is "$1_hFR_0$". A measured value indicating the sound transfer characteristic from the audio output device 132 to the left ear of the listener 320 is "$1_hFL_0$". Further, a measured value indicating the sound transfer characteristic from the audio output device 131 to the left ear of the listener 320 is "$1_hCR_0$". A measured value indicating the sound transfer characteristic from the audio output device 132 to the right ear of the listener 320 is "$1_hCL_0$".

With respect to the above, a state 1000*b* indicates a state in which the listener 320 is seated in the driver's seat of the vehicle 140 and is still for a certain period of time after the sun visor 400 has been lowered. In the state 1000*b*, the acoustic control device 120 according to the second embodiment outputs the sounds through the audio output devices 821 and 822.

In the state 1000*b*, a measured value indicating the sound transfer characteristic from the audio output device 821 to the right ear of the listener 320 is "$2_hFR_{120}$". A measured value indicating the sound transfer characteristic from the audio output device 822 to the left ear of the listener 320 is "$2_hFL_{120}$". Further, a measured value indicating the sound transfer characteristic from the audio output device 821 to the left ear of the listener 320 is "$2_hCR_{120}$". A measured value indicating the sound transfer characteristic from the audio output device 822 to the right ear of the listener 320 is "$2_hCL_{120}$".

As described, the acoustic control device 810 according to the present embodiment switches an audio output device that outputs tree sound in accordance with the rotation angle of the sun visor 400. The sound transfer characteristic from the audio output device to be switched has been measured for each rotation angle of the sun visor 400 to switch the transfer functions A to D that are set in the multipliers 311 to 314 in accordance with the rotation angle of the sun visor 400.

This can continuously localize the sounds output from the audio output devices at the ears of the listener 320 under a more stable condition, even when the listener 320 moves the sun visor 400.

Functional Configuration of the Acoustic Control Device

Figure 11:
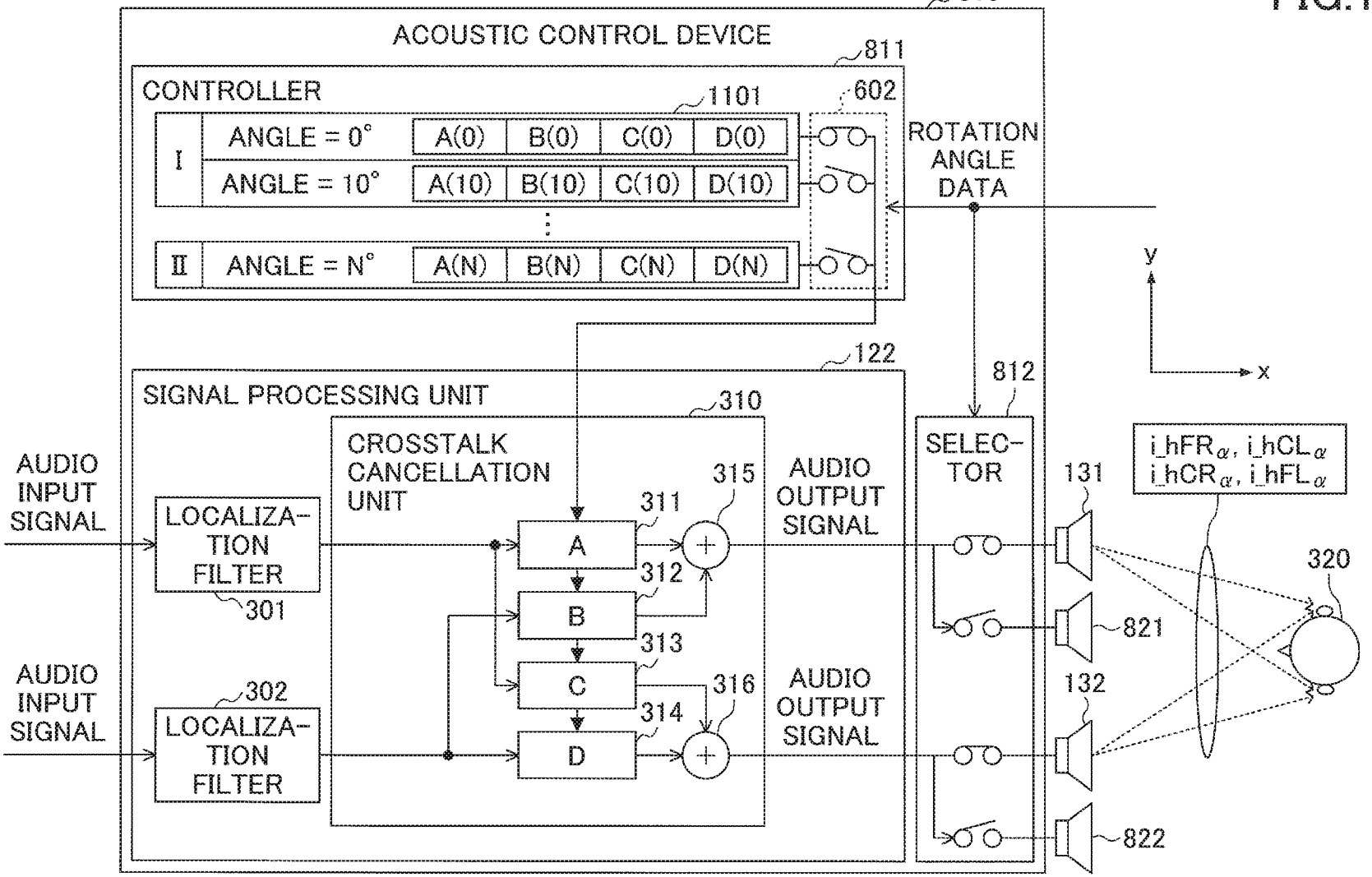
FIG. 11 is a drawing illustrating a functional configuration of the acoustic system according to the second embodiment.

Next, a functional configuration of the acoustic control device 810 according to the second embodiment will be described. FIG. 11 is a drawing illustrating a functional configuration of the acoustic system according to the second embodiment.

As illustrated in FIG. 11, the controller 121 includes a parameter storage unit 1101 and the switching unit 602. The parameter storage unit 1101 stores the transfer functions A to D for each rotation angle of the sun visor 400. Here, when the rotation angle is greater than or equal to 0 degrees and smaller than a predetermined angle, the transfer functions calculated based on the measured values indicating the sound transfer characteristics between the audio output device 131 with the audio output device 132 and the listener 320, are stored. With respect to this, when the rotation angle is from the predetermined angle to N degrees, the transfer functions calculated based on the measured values indicating the sound transfer characteristics between the audio output device 821 with the audio output device 822 and the listener 320, are stored.

Since the structure of the switching unit 602 has been described with reference to FIG. 6 in the first embodiment, the description of the structure will not be repeated here. Similarly, since the configuration of the signal processing unit 122 has been described with reference to FIG. 6 in the first embodiment, the description of the configuration will not be repeated here.

The selector 812 switches between the audio output devices to output the sounds in accordance with the rotation angle data transmitted from the angle sensor 130. When the rotation angle of the sun visor 400 is greater than or equal to 0 degrees and smaller than a predetermined angle, the sound output signals that are output from the signal processing unit 122 are transmitted to the audio output devices 131 and 132. With respect to this, when the rotation angle of the sun visor 400 is greater than or equal to the predetermined angle, the sound output signals that are output from the signal processing unit 122 are transmitted to the audio output devices 821 and 822. The example of FIG. 10A illustrates a case in which the sounds are output through the audio output devices 131 and 132 because the rotation angle of the sun visor 400 is "0 degrees".

Summary

As is clear from the description above, the acoustic system 100 according to the second embodiment performs the following processes:

When the sounds are localized at the ears of the listener seated in the driver's seat of the vehicle, one set among two sets of audio output devices is installed at the end of the sun visor mounted above the ears of the listener. The other set of audio output devices is installed on the central portion of one surface of the sun visor.

For each rotation angle, the sound transfer characteristics are measured and the transfer functions calculated based on the measured values are stored in advance.

Signal processing is performed on the audio input signals using the transfer functions in accordance with the rotation angle. The audio output signals generated by the signal processing being performed are transmitted to the audio output devices in accordance with the measured rotation angle.

Thus, even when the installation positions of the audio output devices are changed by the listener moving the sun visor, the acoustic control device 810 can switch between the transfer functions in accordance with the installation positions and can switch between the audio output devices in accordance with the installation positions.

As a result, the present embodiment can continuously localize the sounds output from the audio output devices at the ears of the listener under a more stable condition.

Third Embodiment

In the first and second embodiments described above, a case in which the audio output devices and the angle sensor are installed on the sun visor 400, is described. However, a member inside the vehicle 140 on which the audio output devices and angle sensor are installed, is not limited to the sun visor 400. For example, the audio output devices and angle sensor may be installed on a rear-view mirror inside the vehicle 140. In the following, a third embodiment will be described focusing on differences from the first and second embodiments described above.

Installation Example of the Acoustic System

Figure 12:
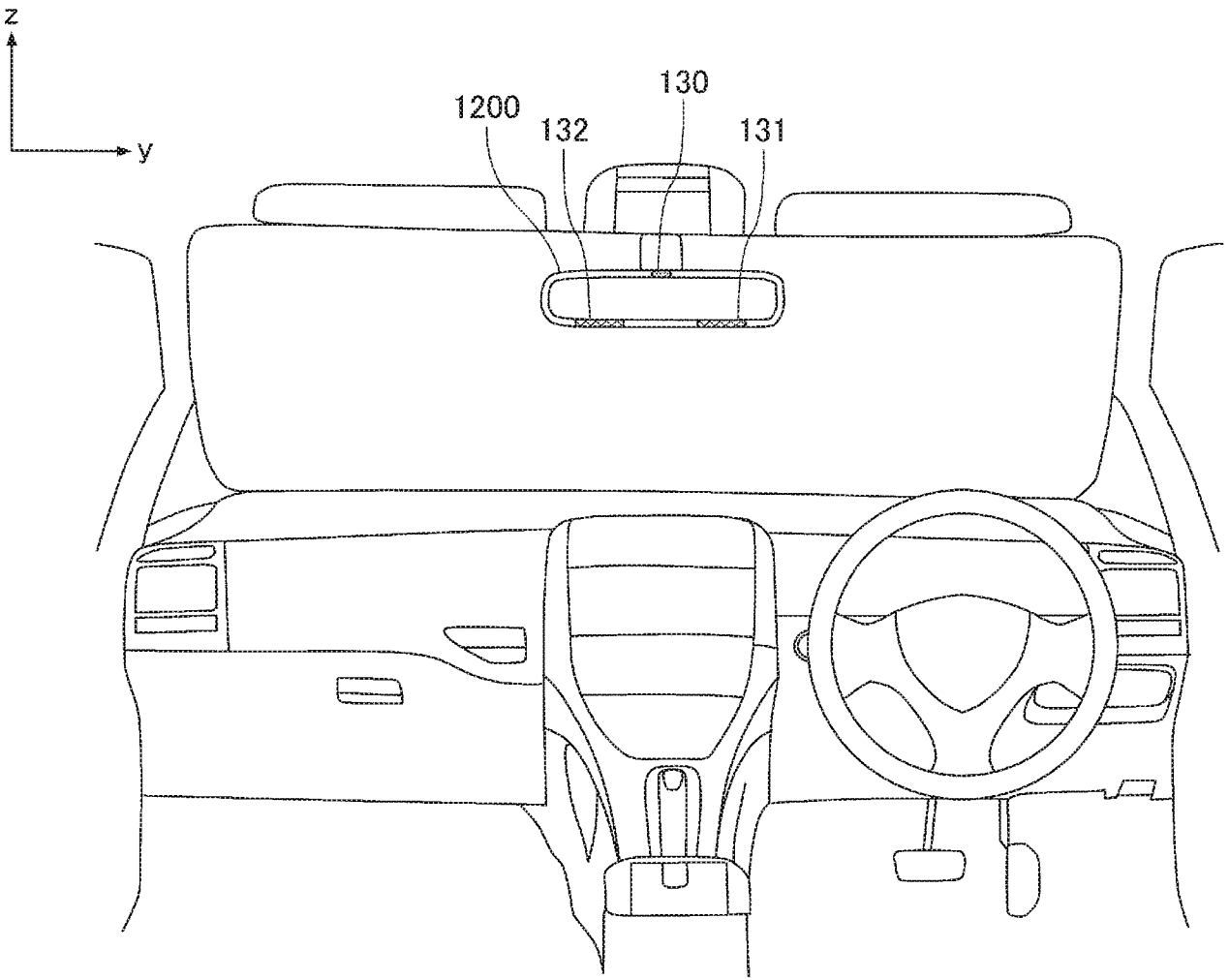
FIG. 12 is a drawing illustrating an installation example of each device constituting an acoustic system according to a third embodiment inside a vehicle.

First, an installation example of each device constituting the acoustic system 100 inside the vehicle 140 will be described. FIG. 12 is a drawing illustrating an installation example of each device constituting the acoustic system according to the third embodiment inside the vehicle. The example of FIG. 12 illustrates a state in which the audio output devices 131 and 132, and the angle sensor 130, which constitute the acoustic system 100, are installed on a rear-view mirror 1200 of the vehicle 140.

As illustrated in FIG. 12, the audio output devices 131 and 132 are installed along the y-axis direction at an end of the rear-view mirror 1200. Specifically, when viewed from the driver's seat side, the audio output device 131 is installed on the right side and the audio output device 132 is installed on the left side.

Thus, in the acoustic system 100 according to the third embodiment, as in the first and second embodiments, the audio output devices 131 and 132 are installed above the ears of the listener 320 seated in the driver's seat, at which the audio output signals are localized.

This enables the acoustic system 100 to prevent the sound transfer characteristics between the audio output device 131 with the audio output device 132 and the listener from being changed by an obstacle interfering with the sounds between the audio output device 131 with the audio output device 132 and the listener 320. As a result, the acoustic system 100 can continuously localize the sounds output from the audio output devices 131 and 132 at the ears of the listener 320.

As illustrated in FIG. 12, the angle sensor 130 is installed on a rotating portion of the rear-view mirror 1200 to measure the rotation angle about the y-axis and the z-axis of the rear-view mirror 1200. This enables the angle sensor 130 to measure the rotation angle of the rear-view mirror 1200 in real time. As a result, even when the rotation angle of the rear-view mirror 1200 (i.e., the installation positions of the audio output devices 131 and 132) are changed, the acoustic control device 120 can measure the changed rotation angle in real time, and perform the signal processing in accordance with the changed rotation angle. That is, the acoustic system 100 can continuously localize the sounds output from the audio output devices 131 and 132 at the ears of the listener 320.

Functional Configuration of the Acoustic Control Device

Figure 13:
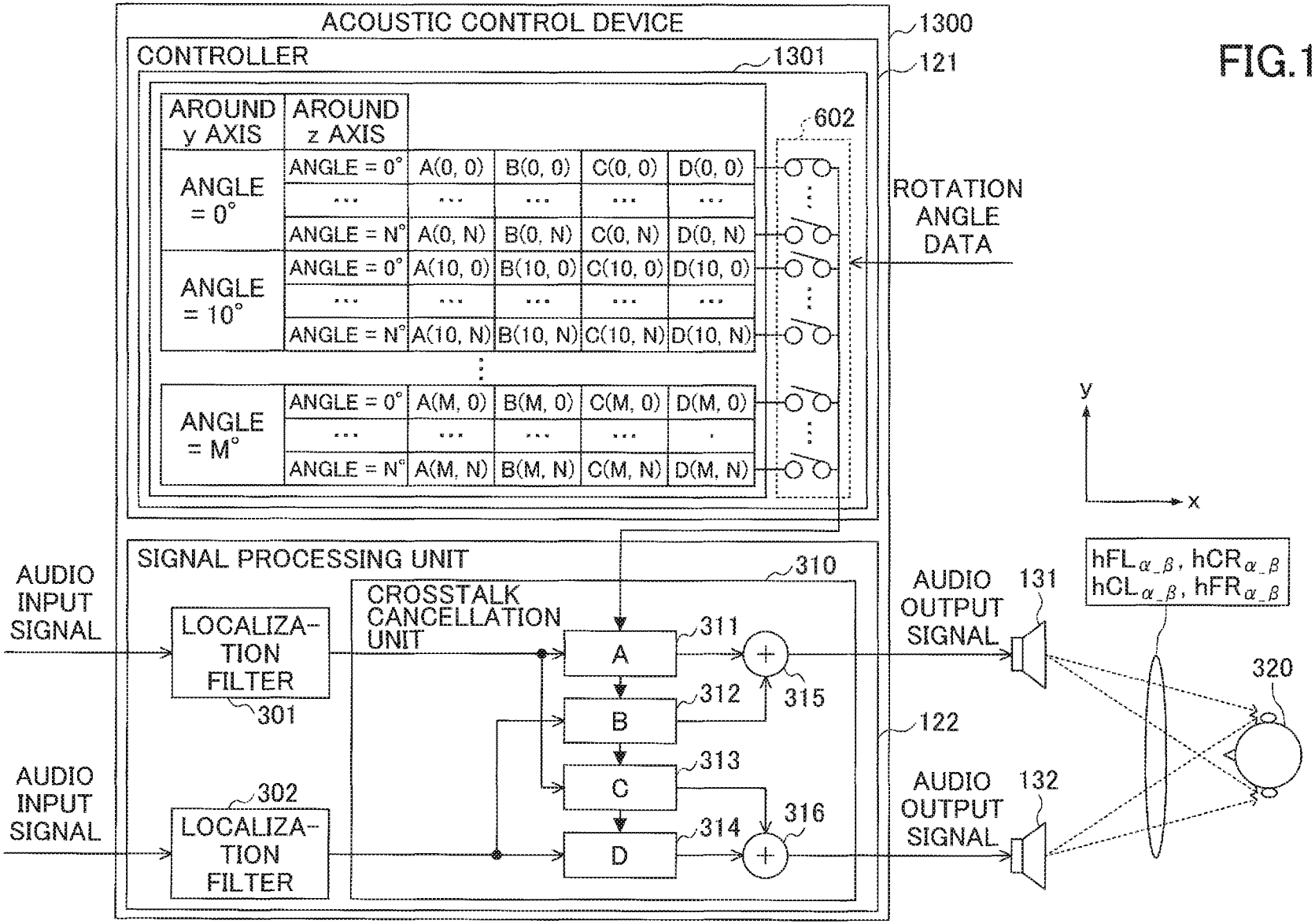
FIG. 13 is a drawing illustrating a functional configuration of the acoustic system according to the third embodiment.

Next, a functional configuration of the acoustic control device according to the third embodiment will be described. FIG. 13 is a drawing illustrating the functional configuration of the acoustic system according to the third embodiment.

As illustrated in FIG. 13, in the acoustic control device 1300 according to the third embodiment, the controller 121 includes a parameter storage unit 1301 and the switching unit 602. The parameter storage unit 1301 stores the transfer functions A to D for each rotation angle of the rear-view mirror 1200. Since the rear-view mirror 1200 rotates at least around the y-axis and the z-axis, the transfer functions A to D are stored in the parameter storage unit 1301 for each angle around the y-axis and each angle around the z-axis.

Since the configuration of the switching unit 602 and the signal processing unit 122 has been described with reference to FIG. 6 in the first embodiment, the description will not be repeated here.

Summary

As is clear from the description above, in the acoustic system 100 according to the third embodiment, the audio output devices are installed at the end of the rear-view mirror mounted above the ears of the listener when the sounds are localized at the ears of the listener seated in the driver's seat of the vehicle.

This enables the acoustic system 100 according to the third embodiment to prevent the sound transfer characteristic between the audio output device and the ears of the listener from being changed by an obstacle interfering with the sound between the audio output device and the ears of the listener.

The acoustic control device 1300 according to the third embodiment performs the following processes:

The sound transfer characteristics are measured for each rotation angle around the y-axis and for each rotation angle around the z-axis, and the transfer functions calculated based on the measured values are stored in advance.

The signal processing is performed on the audio input signals using transfer functions corresponding to the measured rotation angle around the y-axis and the measured rotation angle around the z-axis.

Thus, even when the installation positions of the audio output devices are changed by the listener moving the rear-view mirror, the acoustic control device 1300 can switch transfer functions in accordance with the installation positions to perform the signal processing.

As a result, the present embodiment can continuously localize the sounds output from the audio output device at the ears of the listener.

Other Embodiments

In the first to third embodiments described above, although the sun visor and the rear-view mirror are described as predetermined members inside the vehicle on which the audio output devices and the angle sensor are installed, the audio output devices and the angle sensor may be installed on a movable member other than the sun visor and the rear-view mirror.

The first to third embodiments described above are configured such that the angle sensor is installed on the movable member, and the transfer functions are switched for each rotation angle. However, a sensor installed on the movable member is not limited to the angle sensor. Any sensor can be installed (e.g., an imaging device) as long as the sensor can measure data for determining a positional relation between a part at which the sound is localized and the audio output device. In this case, the transfer functions are stored in the parameter storage unit for each data determining the positional relation between the specific part of the listener and the audio output device, and the switching unit switches the transfer functions for each data determining the positional relation.

In the third embodiment described above, the angle sensor 130 has been described as a sensor that measures the angle around the y-axis and the angle around the z-axis, but the angle sensor 130 may also measure the angle around the x-axis. In this case, the transfer functions are also switched for each rotation angle around the x-axis.

In the first to third embodiments described above, a case in which the acoustic control device and the generating device are configured separately, has been described. However, the acoustic control device may be configured as a part of the generating unit.

In the first to third embodiments described above, a case in which the audio output device is installed on the movable member (e.g., the sun visor 400 or the rear-view mirror 1200), has been described. However, as long as the audio output device is above the ears of the listener 320, the installation position of the audio output device is not limited to the movable member, and the audio output device can be installed on any member. For example, the audio output device may be installed on a ceiling or a front pillar of the vehicle 140.

In the first to third embodiments described above, a moving object to which the acoustic system is mounted has been described as the vehicle 140, but the acoustic system may be mounted to a moving object other than the vehicle 140 (e.g. a ship, a train, an aircraft, and so on).

In the first to third embodiments described above, as an example of a state in which the listener is still, a case in which the listener is seated in the driver's seat of the vehicle 140 has been described, but the state is not limited to this. For example, the listener may be seated in a seat other than the driver's seat of the vehicle 140, or may be seated in a driver's seat or a seat other than the driver's seat of a moving object other than the vehicle 140. The listener is not limited to being seated but may be standing.

In the first to third embodiments described above, the acoustic system 100 has been described as being installed on the movable member mounted to the moving object, but the installation position is not limited to this. For example, the acoustic system may be installed in a movable object, such as a robot that moves in a predetermined range.

The present invention is not limited to the configuration described here, such as the configurations described in the above embodiments, and a combination of other elements. According to these points, changes can be made without departing from the spirit and scope of the present invention, and can be appropriately determined in accordance with a configuration of an application.

What is claimed is:

1. An acoustic system comprising:

a plurality of audio output devices configured to output sounds to a listener, the listener being still at least for a predetermined period of time; and an acoustic control device configured to perform signal processing for localizing, at a specific part of the listener, the sounds that are output through the plurality of audio output devices, wherein the acoustic control device switches between the plurality of audio output devices through which the sounds are output in accordance with a positional relation between the specific part of the listener and each of the plurality of audio output devices.

2. The acoustic system as claimed in claim 1, wherein the plurality of audio output devices are installed on a movable member, the acoustic system further comprising a sensor configured to measure data for determining the positional relation between the specific part of the listener and each of the plurality of audio output devices.

3. The acoustic system as claimed in claim 2; wherein the acoustic control device switches a parameter used for the signal processing, for each positional relation determined by the data measured by the sensor.

4. The acoustic system as claimed in claim 3, wherein the parameter is calculated based on a sound transfer characteristic between the audio output device and the specific part of the listener.

5. The acoustic system as claimed in claim 3, wherein a plurality of sets of the audio output devices are installed above the specific part of the listener, the plurality of sets of the audio output devices outputting sounds, and wherein the acoustic control device switches between the plurality of sets of the audio output devices through which the sounds are output in accordance with a positional relation between the specific part of the listener and each of the plurality of sets of the audio output devices, the positional relation being determined by the data measured by the sensor.

6. The acoustic system as claimed in claim 2, wherein the movable member is a sun visor or a rear-view mirror mounted inside a vehicle.

7. The acoustic system as claimed in claim 6, wherein the sensor is an angle sensor.

8. An acoustic control device comprising a memory; and a processor coupled to the memory:

that obtains data for determining a positional relation between each of a plurality audio output devices and a specific part of a listener at which a sound that is output through each of the plurality of audio output devices is localized, the listener being still at least for a predetermined period of time, and that performs signal processing for localizing, at the specific part of the listener, the sound that is output through each of the plurality of audio output devices, and a controller configured to switch between the plurality of audio output devices in accordance with the positional relation between the specific part of the listener and each of the plurality of audio output devices.

9. A non-transitory computer-readable recording medium having stored therein a control program for causing a computer to execute a method comprising:

obtaining data for determining a positional relation between each of a plurality of audio output devices and a specific part of a listener at which a sound that is output through each of the plurality of audio output devices is localized, the listener being still at least for a predetermined period of time; and performing signal processing for localizing, at the specific part of the listener, the sound that is output through each of the plurality of audio output devices, and switching between the plurality of audio output devices in accordance with the positional relation between the specific part of the listener and each of the plurality of audio output devices.

* * * * *